US005667733A

United States Patent [19]

Waldron, Sr.,

[11] Patent Number: 5,667,733

[45] Date of Patent: *Sep. 16, 1997

[54] AEROSOL GENERATOR AND METHOD FOR EFFECTING THE SIZE OF DROPLETS DISPERSED THEREBY

[75] Inventor: David W. Waldron, Sr.,, Valdosta, Ga.

[73] Assignee: Lowndes Engineering Co., Inc., Valdosta, Ga.

[ * ] Notice: The term of this patent shall not extend beyond the expiration date of Pat. No. 5,248,448.

[21] Appl. No.: 359,030

[22] Filed: Dec. 19, 1994

Related U.S. Application Data

[63] Continuation of Ser. No. 932,085, Aug. 19, 1992, abandoned.

[51] Int. Cl.[6] ..... B05B 7/02; B05B 7/12

[52] U.S. Cl. ..... 261/30; 239/77; 239/403; 239/405; 239/412; 252/305; 261/78.2; 261/81

[58] Field of Search ..... 252/305; 261/78.2, 261/18.1, 30; 239/77, 403, 405, 412; 137/169, 625.13, 625.15, 625.17, 831, 832

[56] References Cited

U.S. PATENT DOCUMENTS

| | | | |
|---|---|---|---|
| 239,412 | 11/1881 | Smith | 76/15 |
| 662,319 | 11/1900 | Smith | 239/412 |
| 2,913,232 | 11/1959 | Silverman | 261/40 |
| 3,120,228 | 2/1964 | Huxley, III | 128/30 |
| 3,349,042 | 10/1967 | Andrews | 252/305 |
| 3,416,570 | 12/1968 | Kervin | 137/625.17 |
| 3,702,306 | 11/1972 | Waldron | 252/305 |
| 4,992,206 | 2/1991 | Waldron | 252/305 |
| 5,156,776 | 10/1992 | Loedding et al. | 261/27 |
| 5,248,448 | 9/1993 | Waldron et al. | 252/305 |

*Primary Examiner*—Richard D. Lovering
*Attorney, Agent, or Firm*—Isaf, Vaughan & Kerr

[57] ABSTRACT

An ultra low volume fog or aerosol generator produces a fog with droplets whose particle size or sizes are easily varied from about 5 microns to about 20 microns during the operation of the machine. This generator includes an air blower, the discharge of which is directed along a prescribed path, thence, through a passageway and, thence, through a nozzle into the ambient air. Liquid supplied to the nozzle is entrained by the air as it passes through the nozzle for producing finely droplets dispersed in the air. The particle sizes of the droplets are regulated by altering the volume of air discharged through the nozzle by means of an air regulator valve, which diverts a portion of the air from its prescribed path. An electrical motor controls the opening and closing of the air regulator valve.

In one embodiment, the motor cyclically modulates the opening and closing of the valve. In another embodiment, the motor is a reversible, D.C., stepping motor, the rotation of which alters the position of the gate in the valve to prescribe the amount to which the valve is opened or closed.

9 Claims, 8 Drawing Sheets

AEROSOL GENERATOR AND METHOD FOR EFFECTING THE SIZE OF DROPLETS DISPERSED THEREBY

This is a continuation of application Ser. No. 08/932,085 filed on Aug. 19, 1992, now abandoned.

TECHNICAL FIELD

The present invention relates to aerosol generators (also known as fog generators). More particularly, the invention relates to an apparatus and method for dispersing pesticides, defoliants, fungicides and other chemicals in which the air pressure and the particle size of liquid droplets dispersed from the generator are regulated.

BACKGROUND OF THE INVENTION

Many of the current foggers used for spraying or dispersing liquid particles, such as pesticides, defoliants, fungicides and other chemicals, are known as ultra-low volume (ULV) cold aerosol generators or fog generators. Such devices normally include a prime mover such as a small gasoline-powered engine, an air blower assembly driven by the prime mover, a nozzle assembly, a supply tank for the liquid, and a suitable control means. The liquid is normally fed into the nozzle assembly where it is entrained in the airstream flowing therethrough and is dispersed into the atmosphere as a fog of small droplets. See commonly owned U.S. Pat. No. 4,992,206, herein incorporated by reference.

As the technology for cold aerosol generators has evolved, it has become evident that it is highly desirable to be able to control or effect the amount of air pressure actually delivered from the air blower to the nozzle assembly and thereby control the size or sizes of the liquid droplets being dispensed by the fog generator.

Control of droplet size is critical, for not only environmental and economic considerations, but also because the droplet sizes must comply with the legal regulations for the particular chemical being applied. Legal regulations are promulgated by the United States Environmental Protection Agency and by state and local governments for various chemicals. These regulations typically limit the maximum chemical droplet size in the fog and a chemical's maximum application rate per unit area.

The droplet size is also critical in that its size must be such that it can be properly applied both in terms of its effectiveness and its dispersion range. It has been observed in the art that droplets below a certain size are ineffective because much of these droplets are carried off by the ambient air without engaging the target insect or plant.

In addition, the chemicals to be dispensed must be applied at or above a minimum application rate per unit area. It will also be appreciated that it is desirable to disperse the chemical such that the chemical will cover and effectively control as large an area as possible. Thus, for each chemical being applied, there is a desired range of droplet sizes and application rates.

Moreover, depending upon the particular use of the chemical, it is desirable to be able either to maintain a dispersion of a constant droplet size, or to maintain a dispersion of droplet sizes that vary within the chemical's legally permissible and effectiveness range. For example, when the liquid to be dispersed is a larvacide it is preferable to dispense larger sized droplets that will fall to the ground after they are suspended. If the liquid to be dispersed is an adultacide, smaller sized droplets are preferred so that the droplets will remain airborne thereby coming in contact with its targets.

In the past, it has been difficult to control or effect the size of the dispersed droplets because the droplet size is directly dependent upon the velocity of air delivered to the nozzle assembly. The air pressure thus produced remains constant because the air blowers engine can only be run at a steady constant output. Although it has been attempted to vary the output of the air blower engine, and hence the air pressure disclosed, this is not cost effective because it greatly reduces the engine life of the air blower.

Consequently, accepting the fact that the amount of air pressure developed is a constant, those skilled in the art have commonly employed several ways to vary the sizes of the dispersed droplets. It is generally recognized that in order to change a droplet size, either the flow rate of the liquid to be dispersed should be changed, and/or the air pressure used to disperse the liquid should be changed. For example, when the air pressure of the air, as it is received by the nozzle assembly, is held constant, and the flow rate at which the liquid to be dispensed is varied, low liquid flow rates will yield small droplets, and high liquid flow rates Will yield large droplets.

Another way to control the size of the disperse droplets is to maintain the delivery of the liquid to be dispensed by the nozzle assembly at a constant flow rate, and vary the air pressure of the air actually delivered to the nozzle assembly. In this type of apparatus, high air pressure yields smaller droplets, and low air pressure yields larger droplets. In the commonly owned and application Ser. No. 07/650,281, now abandoned, the amount of air actually delivered to the nozzle assembly has been controlled by reducing or "bleeding off" a portion of original generated air, through manually adjusting a pressure regulating assembly. However, that type of pressure regulating assembly will only bleed off air at a constant rate. Therefore, the generator will dispense an essentially constant size droplet.

Others in the art have attempted to vary the sizes of the dispensed droplets by providing a cluster or a plurality of nozzle assemblies that respectively dispense preset different sizes of droplets. A fog containing different size droplets can thus be produced if enough nozzle assemblies are used. However, this type of generator can be quite cumbersome and the number of different droplet sizes that it can produce is dependent upon the number of nozzle assemblies, used.

SUMMARY OF THE INVENTION

The inventors of the present invention have invented an apparatus and method for dispensing an aerosol wherein the droplet size of a liquid in the resulting aerosol is a function of the air pressure of the air delivered to the upstream side of the nozzle assembly.

The particular material to be dispersed can be any liquid or any chemical suspended in a liquid. More specifically, the material may be a liquid insecticide or a finely divided solid dispersed in a liquid, including, for example, larvacides, adultacides, herbicides, pesticides, defoliants and fungicides.

The particular embodiments of the present invention include means for controlling or effecting the air pressure of the air, in the air duct between the blower and the nozzle assembly. These embodiments are independent of the flow rate of the liquid being delivered to the nozzle assembly, independent of the speed of the vehicle carrying the fog generator and only requires one nozzle assembly. The air flow is varied by controls affecting the air pressure and hence the amount of air passing through the nozzle assembly, thereby variably controlling the sizes of the dispersed droplets.

In the embodiment of the present invention, a conventional fog generator is used of the type having a blower or compressor for delivering air under pressure, via an air duct or passageway, to a nozzle. In the nozzle, the air passes, as a stream of air, through an axial barrel of the nozzle and, thence, outwardly into the ambient air. Additional air, which is combined with the air from the barrel, is passed through other ports surrounding the barrel. The liquid (fluid), which is mixed with the emerging air, is fed through a tube to the nozzle and then through a radial opening circumferentially inwardly of the mouth of the nozzle, so as to be entrained into the stream of air, thereby producing an aerosol having generally evenly dispersed droplets carried by the air. In the operation of this conventional fog generator, compressed air is partially confined in the duct or passageway due to back pressure on the nozzle.

To control, incrementally, the velocity of the air passing through the barrel, and thereby control the droplet size of the liquid (fluid) being dispensed with the air, we have provided an incrementally variable air pressure regulating apparatus, having an air passageway adaptor and an air release or relief valve, communicating with the adaptor and hence with the duct or passageway. The effective discharge of the compressed air by the valve is controlled by an electric motor.

The air passageway adaptor is an L-shaped conduit fitted into the distal end portion of the duct and supporting the nozzle assembly.

In one preferred embodiment of the invention, the valve comprises a cup-shaped housing with a hollow cylindrical interior mounted by its rim to an elbow portion of the duct so that the valve communicates with the interior of the duct. The side of the housing has a circumferentially disposed slot extending a substantial length around the housing so as to define a discharge opening or port.

Concentrically received within the housing is a second, smaller cup-shaped member, the cylindrical wall of which forms a movable, i.e. rotatable, valve gate. This second cup has a cylindrical wall or sleeve which forms the gate, the wall having a circumferentially disposed slot, forming an air discharge port or outlet, disposed in the same radial plane and incrementally alignable with the discharge opening of the housing. A motor on the housing rotates the second cap so that the valve, thus formed, progressively opens and progressively closes, as the cylindrical valve sleeve or gate is rotated. This, in turn, permits a portion of the compressed air in the duct to be released in progressively increasing amounts and then in progressively decreasing amounts, depending upon the amount of alignment of the two cooperating ports. During prescribed angular positions of this gate, the gate completely closes the discharge port, to block any appreciable release of the compressed air through the valve.

It is to be appreciated that the sleeve or gate is thus constantly rotated within the housing, for constantly varying outlet overlap of the ports, resulting in the relative varying of air pressure in the duct to vary the amount of air passing through the nozzle assembly. As a result, the droplet sizes of the droplets dispensed by the nozzle is also varied.

In the second embodiment of the present invention, a cup-shaped cylindrical housing is provided with a plurality of circumferentially spaced discharge openings or ports in its cylindrical wall. A piston is concentrically received within the cylindrical wall for progressively opening and closing the ports. A rotatable motor moves the piston up and down along the axis of the housing, so that the piston simultaneously covers, partially uncovers, and uncovers the exhaust ports. The exhaust ports are elongated in an axial direction so that position axially of the bottom portion of the piston with respect to the discharge ports defines the amount by which the valve is opened or closed, from a fully opened position to a fully closed position.

The velocity of the air being passed through the nozzle assembly is incrementally varied by moving the piston axially upwardly and downwardly inside of the cylindrical housing. The position of the piston inside the housing will determine the amount of air that is being bled through the discharge ports.

The air pressure regulating piston is threadably connected to the shaft of a reversible DC stepping motor. It will, therefore, be appreciated that as the reversible stepping motor is rotated in one direction or the other, in a stepwise fashion, the piston will likewise be moved stepwise upwardly or downwardly inside of the cylindrical housing.

To prevent the piston itself from rotating inside the cylindrical housing, a positioning means, such as a bolt, is secured to the side of the piston and extends through one of the cylindrical housing's ports, such that the positioning means prevents the piston, itself, from rotating as the shaft of the motor is rotated.

When the valve is closed, the nozzle will receive all of the air passing through the passageway and then the nozzle will produce smaller sized droplets. When the piston has been moved to its uppermost position or fully opened position, a maximum amount of air pressure will be bled through the discharge ports regulating in less air passing through the nozzle. This produces larger sized droplets.

The embodiments of the present invention can effect the dispersion of droplets varying in size from 5 microns to 20 microns. The present invention is therefore particularly useful to effectively disperse insecticides, including larvacides and adultacides.

Accordingly, it is an object of the present invention to provide a cost effective apparatus and method, for producing fog wherein the size of a dispersed liquid droplets is controlled.

Another object of the present invention is to provide an apparatus and method for producing fog wherein the size(s) of the liquid droplets being dispersed is varied during the operation of the apparatus and during the carrying out of the process.

Another object of the invention is to provide an apparatus and method for producing fog wherein a prescribed uniform droplet size for the liquid being dispensed is being maintained.

It is a further object of the invention to provide an apparatus and method for producing a fog wherein a uniformly varying droplet size distribution is produced.

Another object of the present invention is to provide a fog generator in which the droplet sizes of the liquid delivered by the fog generator can be readily and easily altered, as desired.

Another object of the present invention is to provide an inexpensive modification to a conventional fog generator which will enable the fog generator to vary the particle size in the fog delivered.

It is also an additional object of the invention to provide an apparatus and method for dispensing liquids consistent with the above-described objects, wherein the liquids may be insecticides, larvacides, adultacides, herbicides, pesticides, defoliants, fungicides and other chemicals.

Other objects, features and advantages of the present invention will become apparent from the following description, when considered with the accompanying drawings wherein like characters of reference designate corresponding parts throughout the several views.

DETAILED DESCRIPTION OF THE PREFERRED MODES

Figure 1:
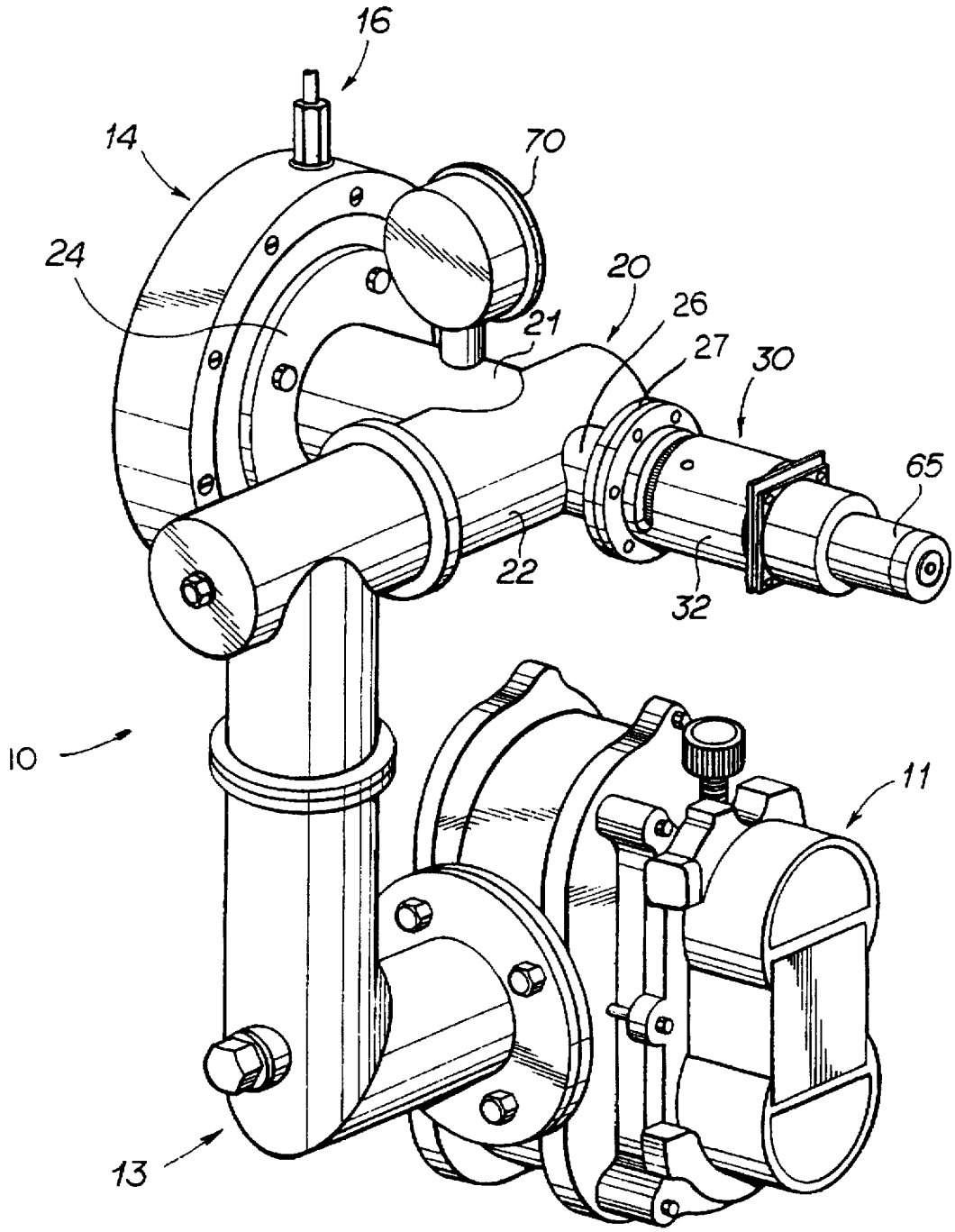
FIG. 1 is a perspective view of an aerosol generator having one form of the air pressure regulating assembly constructed in accordance with the present invention.

Referring now in detail to the embodiments chosen for the purpose of illustrating the present invention, numeral 11 in FIG. 1 denotes generally a conventional air blower or compressor of a conventional aerosol fog generating machine. Air blower 11 is driven by a motor or gasoline engine (not shown). An air duct or passageway, denoted generally by numeral 13, is connected to the blower 11. The duct 13 has a number of interconnecting parts, the discharge end of the air duct being connected to and carrying the aerosol nozzle, denoted generally by the numeral 14. Thus, air under pressure is delivered from the blower 11 through the duct to the central barrel (not shown) of the nozzle 14. Liquid to be dispensed and applied by the aerosol generator 10 as a fog is contained in a liquid container (not shown) and is delivered, under pressure, through a tube 16 to the nozzle 14, the liquid being fed into the path of the stream of air passing through the barrel of the nozzle 14 so that the liquid is mixed with and entrained by the air emerging from the nozzle 14.

Due to the back pressure, generated by the nozzle, and the pressure of the air being delivered by the blower 11 into the duct 13, the air is compressed so as to provide a positive air pressure within the duct during the operation of the machine.

According to the present invention, an air pressure regulating apparatus 20 is added to the elbow portion of the air duct 13 which supports the nozzle 14 so as to form a segment of the air duct between the compressor 11 and the nozzle 14. This apparatus 20 includes an T-shaped conduit or elbow having a base pipe, conduit, or tube 21 connected at a right angle to an intake conduit 22. The conduit 22 is provided with a butt flange that includes a coupling collar 25 for coupling the regulating apparatus 20 to the duct 13 of the blower 11. The proximal end of the conduit 21 is provided with a butt flange 24 which carries, bolted by bolts (not shown), nozzle 14. Conduit 22 is rotatably mounted on the upstanding end portion of duct 13. Hence, air discharged by the compressor or blower 11 passes initially through elbow 13, into conduit 22, then into conduit 21, and then through nozzle 14. The conduits 21 and 22 thus form the uppermost part of the air duct 13.

The axis of the air duct 21 and the air duct 22 are perpendicular to each other while the rotational axis of the connecting portion of the duct 13 is aligned with the axis of the conduit 21. When the proximal end of conduit 22 is secured to the discharge end of the duct 13, the elbow can be rotated in a conventional manner for the purpose of pointing the nozzle 14 in a prescribed direction.

Aligned with the conduit 21 and mounted on the side of the conduit 22 is a smaller conduit 26. The proximal end portion of conduit 26 is welded in place on the conduit 22 while its distal end is provided with a butt flange 27. The passageway of the conduit 26 communicates with the passageway 23.

Figure 2:
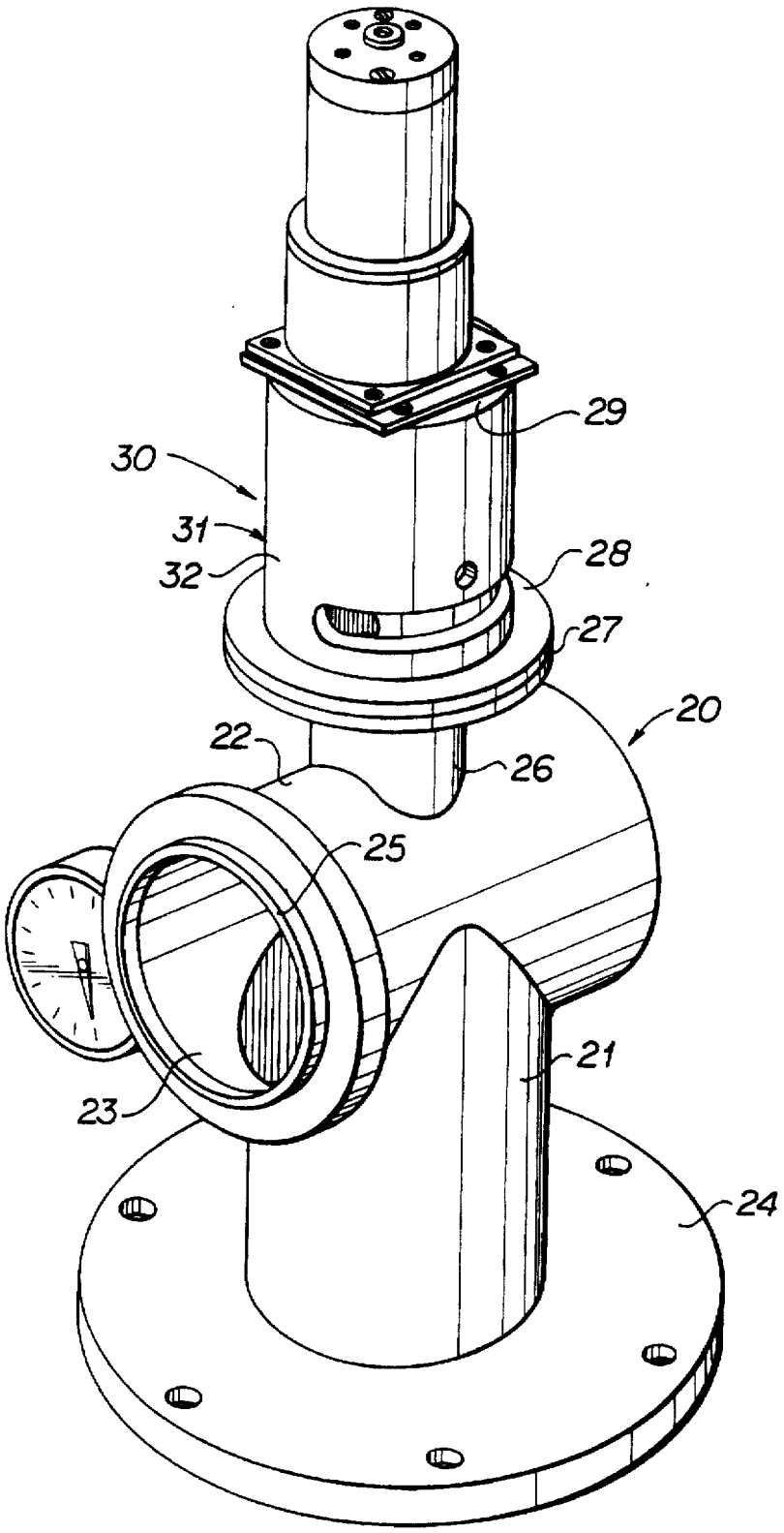
FIG. 2 is an enlarged perspective view of a portion of the air duct and the air pressure regulating assembly of the aerosol generator shown in FIG. 1.
Figure 3:
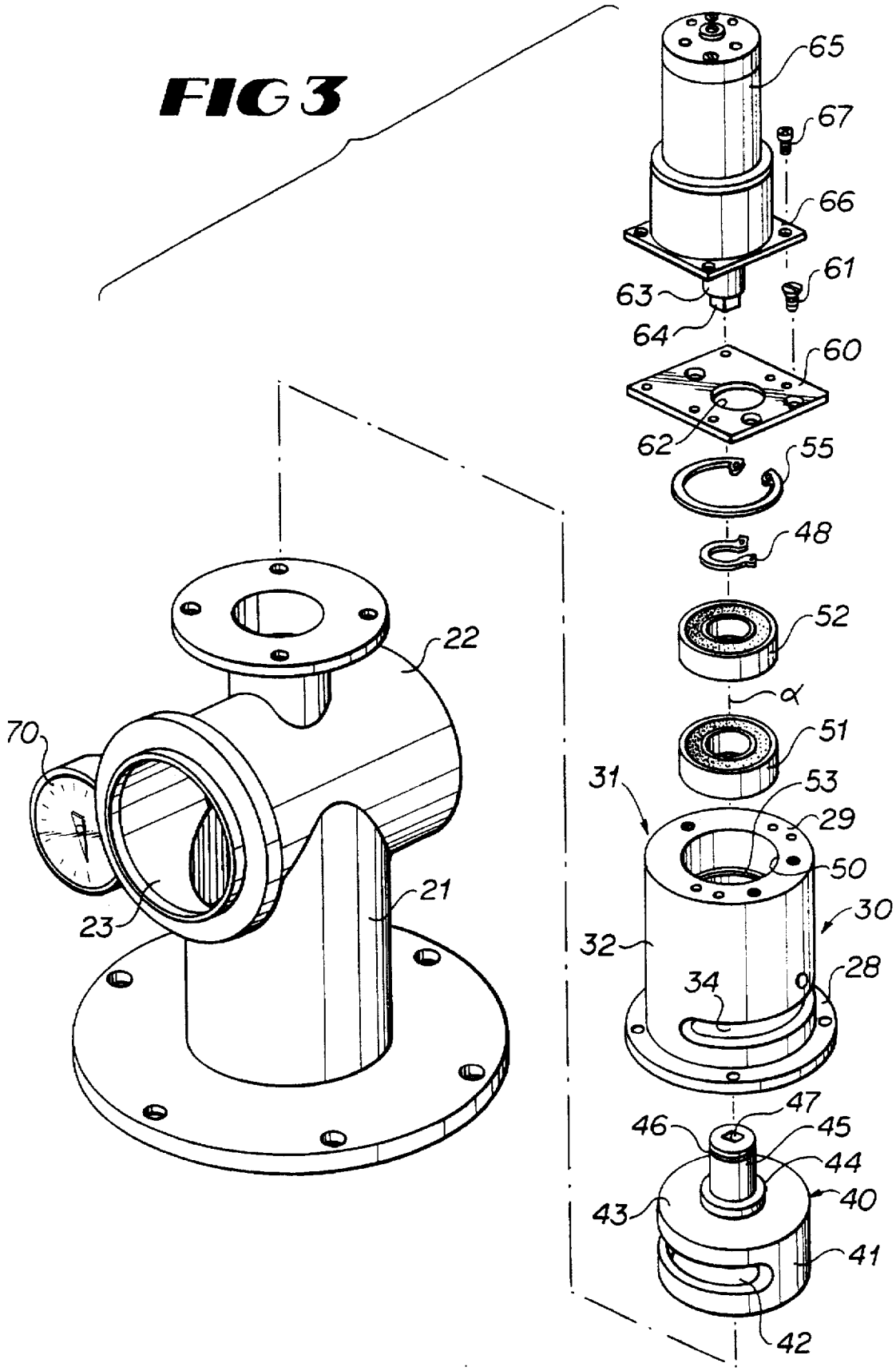
FIG. 3 is an enlarged exploded perspective view of that portion of the aerosol generator shown in FIG. 2.

The butt flange 27 receives a butt flange 28 of a pressure relief valve, denoted generally by the numeral 30. This relief valve 30 includes a cup-shaped housing 31 provided with a cylindrical side wall 32, the lower end of which is welded to the butt flange 28 as seen in FIG. 2. The wall 32 is cylindrical throughout its length and is closed at its upper end by a top plate 29. The wall 32 of housing 31 is concentric with the conduit 26 and the conduit 21, along axis $\alpha$ as seen in FIG. 3. The lower portion, adjacent to the butt flange 28, of the wall 32 is provided with a circumferential air discharge port 34. The air discharge port extending less than 180° i.e. about 160° around the wall 32. It is through this slot or discharge port 34 that the air, within the air duct 13 is vented.

Concentrically and rotationally received within the housing 31 is a sheller cup-shaped member 40 which includes a cylindrical wall 41 which forms a gate of the valve 30. This cylindrical gate fits snugly and rotatably within the cylindrical wall 32 of the housing 31. The gate 41 is provided with a circumferential slot 42 which extends a substantial distance around a portion of the circumference of the wall 41. This circumferential slot or port 42 is adapted to be aligned or partially aligned with the discharge port 34 when the gate 41 is in an appropriate angular position. Indeed, the amount of registry between the discharge port or slot 42 and the discharge port or slot 34 will dictate the amount of air under pressure which is released from the valve 30 upon each revolution of the cup-shape member 40.

By varying the length of either the discharge port 41 or the discharge port 34, when the valve 30 is being machined, the amount of air which is to be bled from the air passageway 23 and the duct 13 can be varied, as desired.

A cap 43 closes the upper portion of the cup-shaped member 40. Concentrically protruding from the cap 43 is an annular shoulder 44 and a smaller stub shaft 45, the shaft 45 and the collar 44 being concentric with the wall 41, along axis $\alpha$. The stub shaft 45 is provided with a peripheral groove 46 at its distal end and also with a square axial hole 47. The groove 46 is adapted to receive a keeper ring 48 therein.

The housing 31 is counterbored to provide a central upper recess or bearing receiving compartment 50 of a diameter sufficient to receive snugly a pair of aligned roller bearings 51 and 52. The counterbored portion 50 terminates at an annular shoulder (not Shown) which limits the inward movement of the roller bearings or needle bearings 51 and 52. Shoulder 44 spaces the cap of the cup member 40 slightly from the shoulder (not shown). Thus, the cup member 40 is free to be rotated within the housing 31 when the shaft 45 is rotated.

The inner periphery of the bearing receiving cavity 50 is provided with a circumferential groove 53 which, when the roller bearings 51 and 52 are appropriately received within the bearing cavity, a keeper ring 55 is received therein. Thus, the bearings are snugly retained within the bearing cavity 50 and the shaft 45, itself, is retained on the bearings by the other keeper ring.

Mounted on the top of the cap 29 of housing 31 is an alignment plate 60 which is appropriately bolted by bolts 61 in place on the surface of cap 29. This alignment plate 60 has an offset central opening 62, through which an offset drive shaft 63 of motor 65 protrudes. This drive shaft 63 has a square protrusion 64 on its end, the protrusion 64 being adapted to protrude into the recess 47. Motor 65 is mounted on a mounting plate 66 and drives the shaft 63 in either direction of rotation. Bolts 67 secure the mounting plate 66 to the alignment plate 60.

Figure 5A:
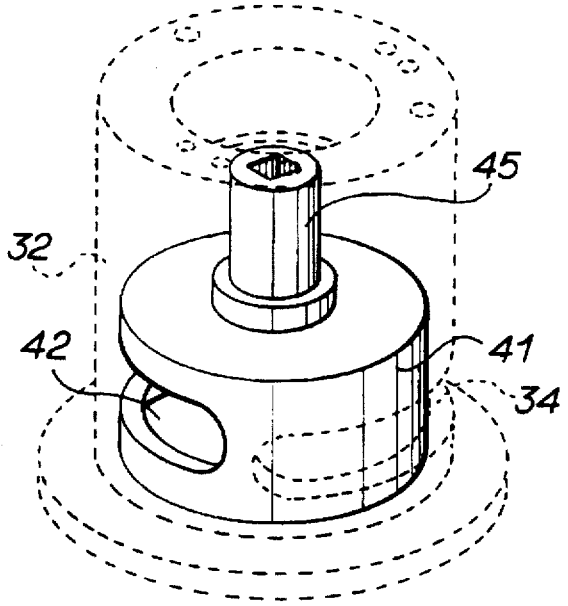
FIG. 5(A) is a cross-sectional view of a portion of the regulating assembly shown in FIG. 1 with the valve closed.
Figure 5B:
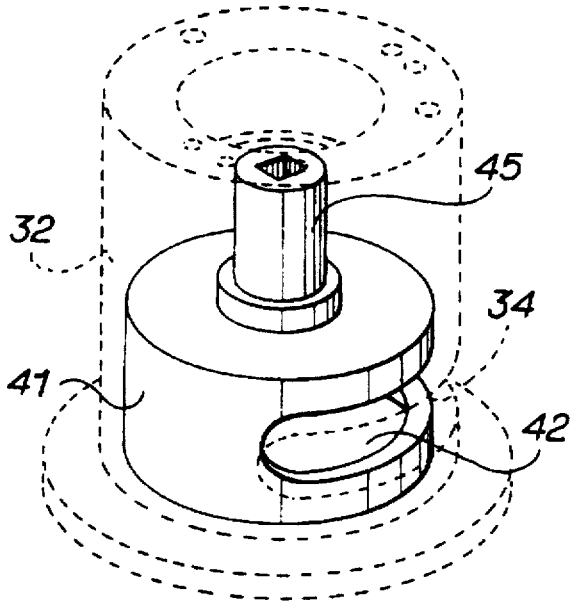
FIG. 5(B) is a view similar to FIG. 5(*a*) and showing the valve fully opened.

It will be understood that the motor 65 will be rotated at different speeds, as dictated by the size distribution of the droplets, which are desired to be created. The speed dictates how long the valve 30 will remain open (see, FIG. 5B) and how long the valve will remain closed (see, FIG. 5A) during each revolution of the gate 41. Thus, during each revolution, the gate 41 completely closes the discharge slot or port 34 for a portion of the time and then, as the port 42 comes into partial alignment with the port 34, the valve is progressively opened until the port 34 is fully opened instantaneously only when the two ports 34 and 42 are in full alignment or registry with each other. Thereafter, the port 34 is progressively closed as the port 32 recedes from its full alignment with port 34 and the gate 41 is again positioned over and closes port 34. The speed of rotation of the cup member 40 and the size of the slots or discharge ports 34 and 42 dictate how much air is vented from the passageway 13 during each revolution of the gate member 40.

Figure 4:
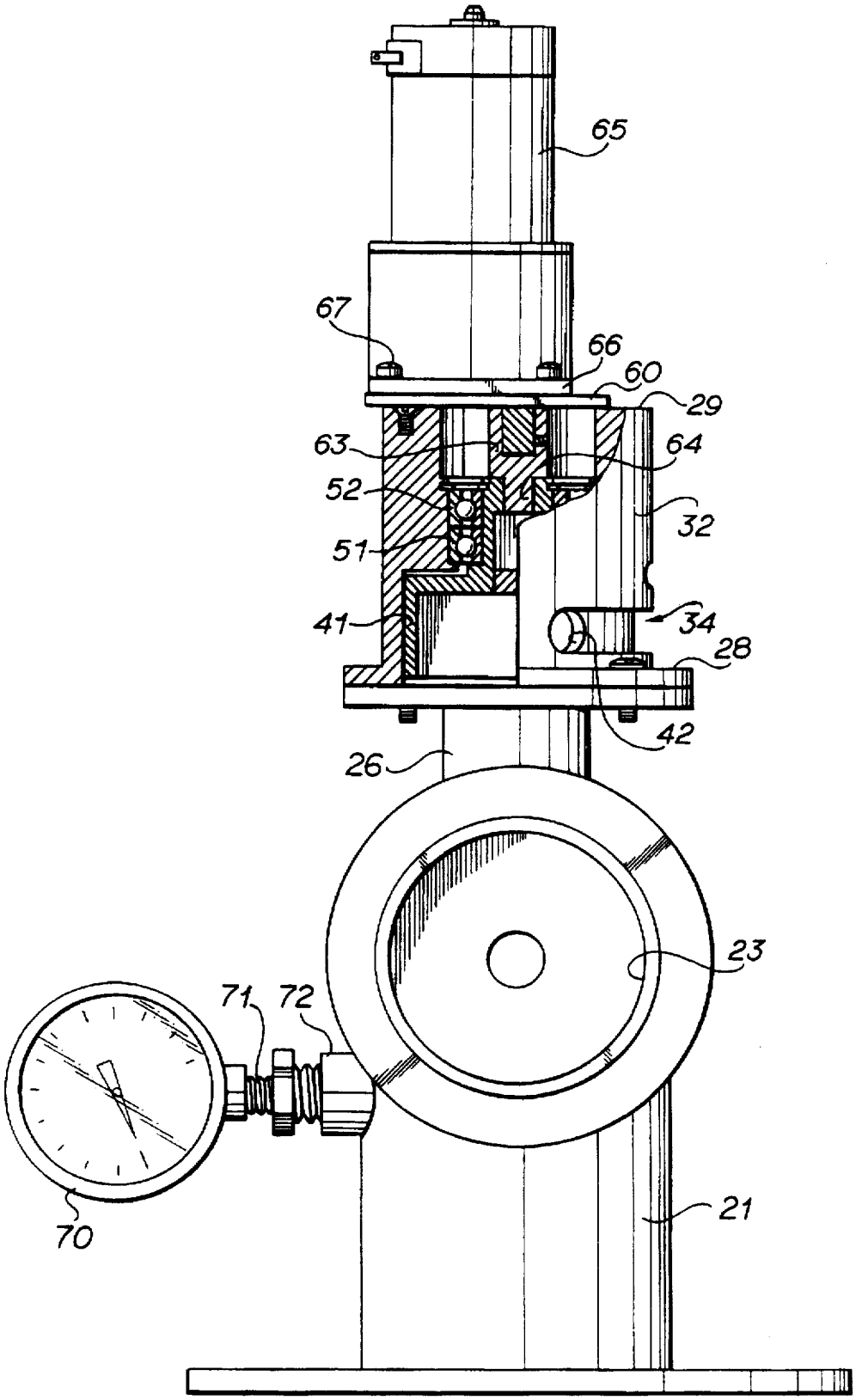
FIG. 4 is a front elevational view, partially broken away, and showing the air duct and air pressure regulating assembly shown in FIG. 2.

For reading the pressure within the passageway 23, and also the fluctuation of this pressure, conduit 21 is provided with a pressure gauge, denoted by the numeral 70. Preferably the gauge stem 71 is threadedly received within a nipple 72 in the side of the conduit 25. See, FIG. 4.

Figure 6A:
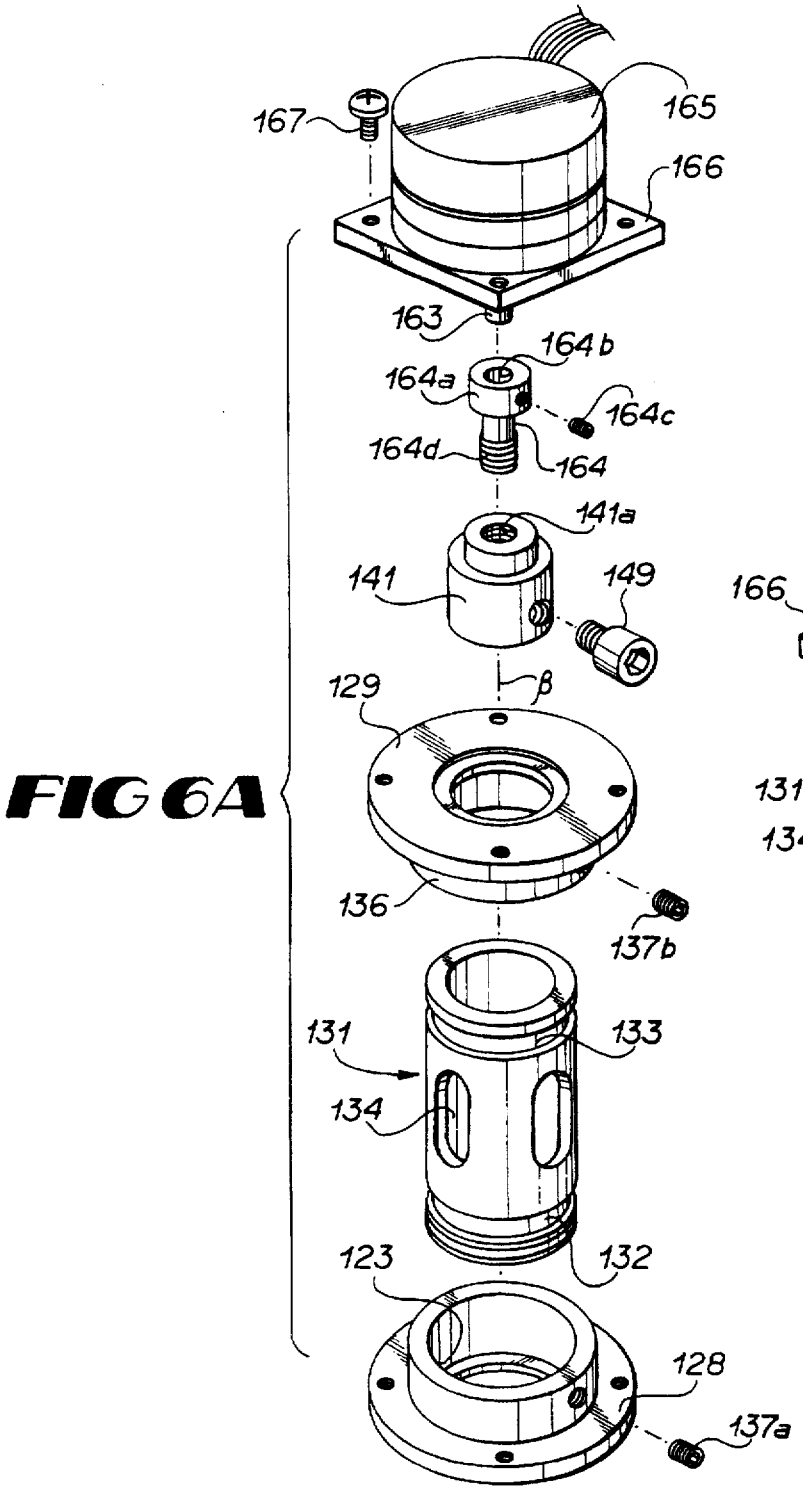
FIG. 6A is an exploded perspective view of a modified form of air pressure regulating assembly, which may be substituted for the air pressure regulating assembly shown in FIGS. 1 through 5(*b*) hereof.
Figure 6B:
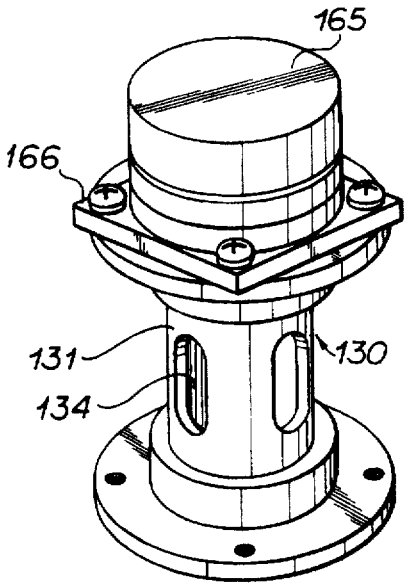
FIG. 6B is a perspective view of the assembled air pressure regulating assembly of FIG. 6A
Figure 7:
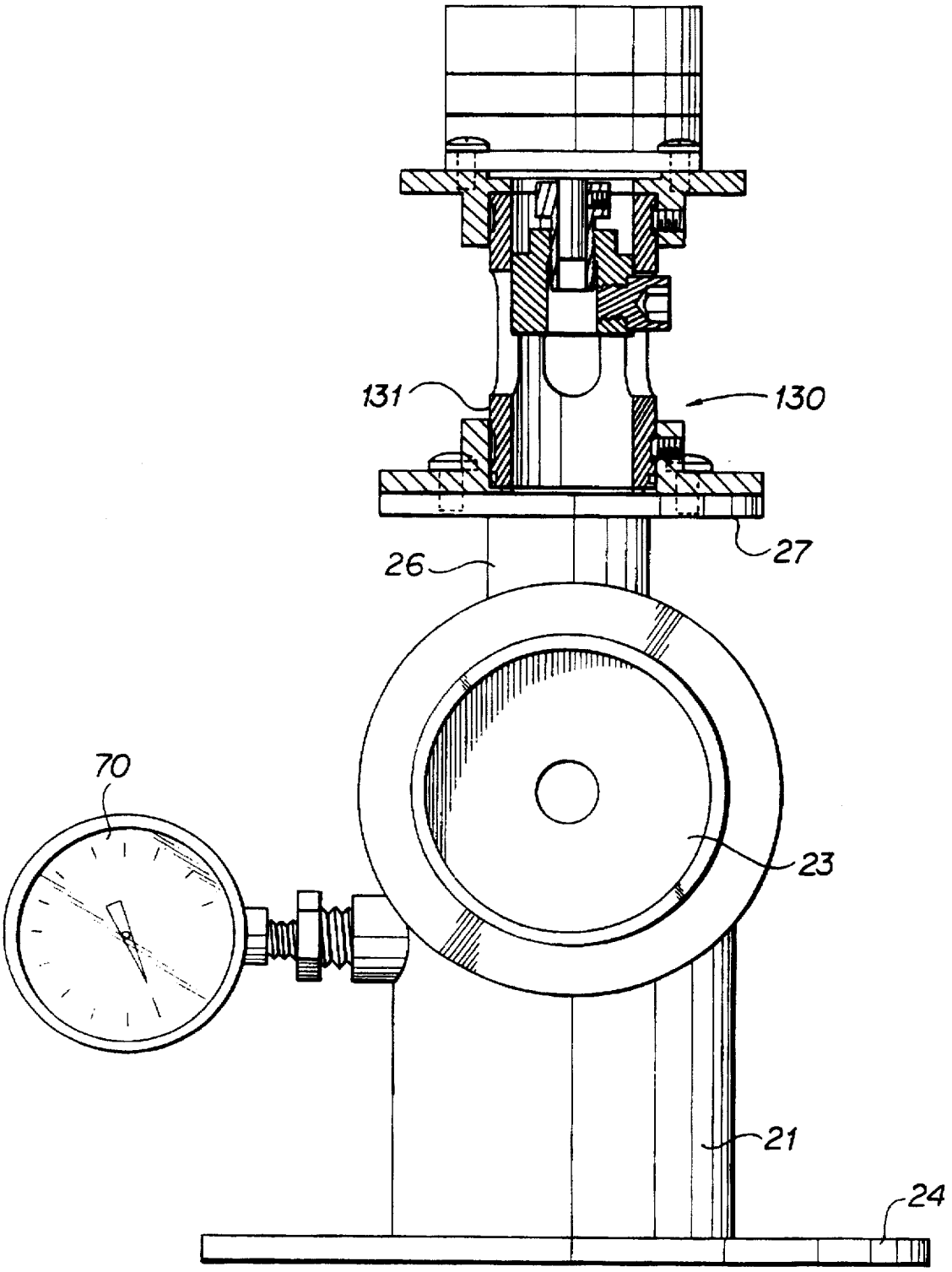
FIG. 7 is a view similar to FIG. 4 but showing the modified form of air pressure regulating assembly shown in FIG. 6.

In the second embodiment depicted in FIGS. 6 and 7, the valve assembly 30 is replaced on flange 27 by a modified air relief valve 130. This air pressure relief valve includes a cup-shaped cylindrical housing 131 which is cylindrical throughout its length, the cylindrical housing 131 being provided with a plurality of circumferentially equally spaced, axially elongated slots or discharge ports centrally through the wall of the housing 131. The lower end portion of the housing 131 as seen in FIG. 6 is received within a collar 123 of a butt flange 128. This end portion is provided with a circumferentially disposed peripheral groove 132 which receives therein a set screw 137(*a*) which protrudes through the collar 132. The upper end portion of the body 131 is provided with a similar peripheral circumferential groove 133 which, when the upper end portion of the housing 131 is received in a collar 136, is secured in place by set screw 137(*b*). The collar 136 is mounted on an upper butt flange 129 which forms the top portion for the housing 131. A disc-shaped piston 141, which has a flat radially extending bottom, is received within the hollow interior of the housing 131 for movement axially along axis β of the housing 131. An Allen head set screw 149, which protrudes through one of the ports 134 and is threadedly received in the side of the piston 141, limits the movement of the piston within the housing 131 so that at one extreme position, the piston or gate 141 fully closes the holes 134 in the collar 123 and the flange 128, thereby shutting off the ports 134 from permitting air to exhaust from the air passageway 26 to the ambient air.

For moving the piston or gate 141 to any number of prescribed openings for the valve, stepping motor 165 is provided on a mounting plate 166, the mounting plate 166 in turn being received on the upper surface of the upper flange 129 and being retained in place by machine screws such as screw 167. The lower end of rotatable shaft 163 is adapted to be received in an end bore 164*b* of a threaded coupler 164, where it is locked in place by a locking screw 164*c*. The threaded coupler 164 is provided with a collar 164*a* on its upper end and threads 164*d* on its lower end. Threads 164*d* are adapted to be threadably coupled with internal threads 141*a* of piston 141. This threaded end of shaft 164*d* is threadedly received in a collar fixed on the upper portion of the piston or gate 141.

Figure 8A:
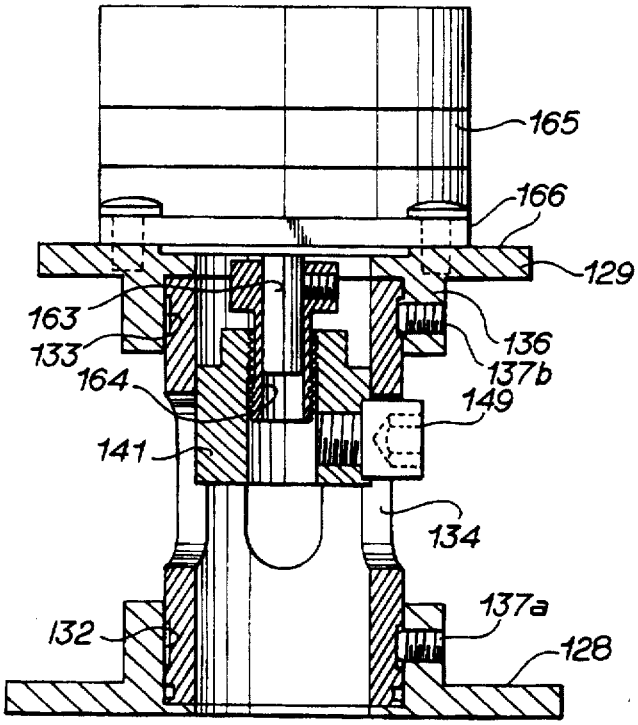
FIG. 8(A) is a cross-sectional view of a portion of the valve of the modified air pressure regulating assembly and showing its valve in an opened position.
Figure 8B:
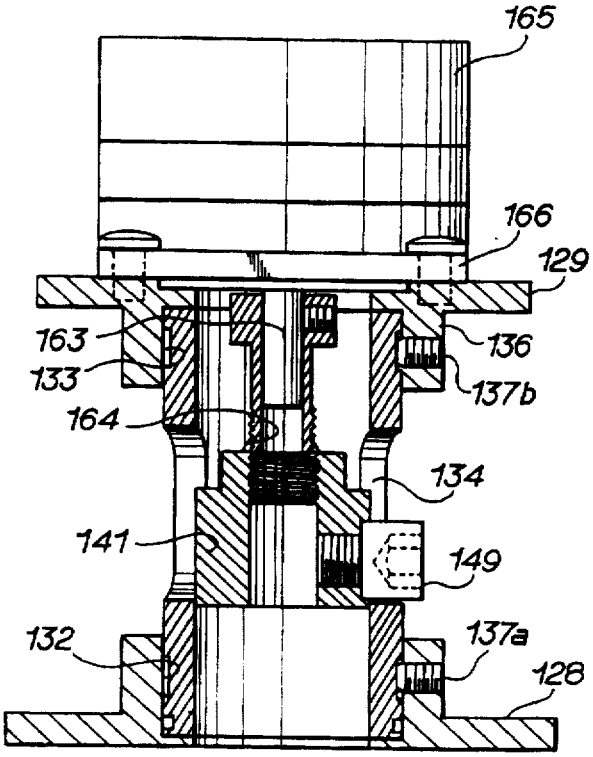
FIG. 8(B) is a view similar to FIG. 8(*a*) and showing the valve in a closed condition.

When the motor 165 is actuated, the shaft 163 is rotated about axis β, clockwise or counter-clockwise. This, in turn, rotates threaded coupler 164 to move the threaded end of coupler 164 into or out of the threaded bore of the piston 141. The piston 141 is thus moved longitudinally or axially within housing 131 upon activation of the motor 165. When shaft 163 is rotated clockwise, this moves the piston 141 incrementally, step by step in an axial direction from a fully closed position (see, FIG. 8B) to a fully opened position (see, FIG. 8A). In the fully closed position, as explained above, the ports 134 are closed so that no air is vented from the passageway 26; however, when the shaft 163 is rotated in a counter-clockwise direction, the piston or gate 141 is moved from an opened position toward a closed position.

Of course, the travel of the piston or gate 141 is limited by the pin 149 traveling in one of the slots 134. Furthermore, the pin 149 prevents rotation of the piston within the housing 131.

It will be obvious to those skilled in the art that many variations may be made in the embodiments here chosen to depict the preferred embodiments of the present invention, without departing from the scope thereof, as defined by the appended claims.

I claim:

1. An aerosol generator comprising:

(a) an air blower having an air discharge side;

(b) a nozzle defining a path of travel for an air stream from its air receiving side to its discharge side and thence, into the ambient air, said nozzle being adapted to entrain liquid into said air stream for producing droplets dispensed in said air as it is discharged from said nozzle;

(c) a robe for supplying liquid to said nozzle for being entrained in said air stream;

(d) a duct connected between the discharge side of said blower and said air receiving side of said nozzle for directing air discharged from said discharge side of said blower to said air receiving side of said nozzle;

(e) a valve communicating with said duct for diverting varying portions of the air passing through said duct from being delivered to said nozzle, depending upon the amount of opening of said valve;

(f) said valve being configured to be cycled progressively between a first condition wherein a first portion of the air passing through said duct is discharged to ambience and a second condition wherein a second portion of the air passing through said duct is discharged to ambience; and (g) a motor for cycling said valve repeatedly between its first and second conditions.

2. The generator defined in claim 1 wherein said valve includes a gate which is moved by said motor for varying the opening of said valve.

3. The generator defined in claim 1 wherein said valve includes a housing, a gate disposed within said housing and a shaft extending from said motor to said gate for moving said gate upon actuation of said motor.

4. The generator defined in claim 1 wherein said valve includes a housing having a discharge port through which air diverted from said duct is discharged, a gate for opening and closing said port, said motor having a shaft connected to said gate for moving said gate.

5. The generator defined in claim 1 wherein said housing is cylindrical and wherein said port is provided the cylindrical portion of said housing, and said gate includes a rotatable member for closing and opening said port upon rotation of said motor.

6. The generator defined in claim 5 wherein said gate is a piston moveable along an axis within said housing for opening and closing said port progressively as said piston is moved along said axis in one direction or the other and wherein said motor includes a means extending from said motor to said piston for moving said piston along said axis.

7. An aerosol generator comprising an air blower; an air duct having a first end communicating with said air blower and a second end, a nozzle assembly coupled to said second end of said air duct and to a source of liquid for receiving an air flow from said air duct and entraining liquid in the air flow to generate an aerosol, and valve means communicating with said air duct for venting a progressively varying portion of the air flow in said air duct to ambience for progressively varying the volume of air passing through said nozzle.

8. An aerosol generator as claimed in claim 7 and wherein said valve means comprises an external housing with a first port formed therein, an internal member disposed in said external housing and having a second port formed therein, said internal member being progressively movable between a first position wherein said first and second ports are substantially misaligned and a second position wherein said first and second ports are substantially aligned, and means for cycling said internal member between its first and second positions.

9. An aerosol generator as claimed in claim 8 and wherein said internal member is rotated within said external housing between its first and second positions.

* * * * *